US006006455A

United States Patent [19]

Miller

[11] Patent Number: 6,006,455

[45] Date of Patent: Dec. 28, 1999

[54] MAGNETIC NAME-TAG

[76] Inventor: Marilyn Miller, 5422 Shawnee, Sierra Vista, Ariz. 85635

[21] Appl. No.: 09/028,185

[22] Filed: Feb. 23, 1998

[51] Int. Cl.[6] ..... A44C 3/00

[52] U.S. Cl. ..... 40/1.6; 40/661; 40/661.01; 40/775

[58] Field of Search ..... 40/1.5, 1.6, 661, 40/661.01, 600, 621, 775, 776; 2/247, 244

[56] References Cited

U.S. PATENT DOCUMENTS

| | | | |
|---|---|---|---|
| 3,466,774 | 9/1969 | Borresen | 40/661.01 |
| 4,055,909 | 11/1977 | Perry | 40/124.2 |
| 5,156,274 | 10/1992 | Williams, Jr. et al. | 40/591 |
| 5,369,899 | 12/1994 | Reeves | 40/1.5 |
| 5,621,990 | 4/1997 | Blanchard | 40/776 |
| 5,740,557 | 4/1998 | Reid et al. | 40/636 |
| 5,784,816 | 7/1998 | Zapawa | 40/654.01 |

*Primary Examiner*—Cassandra H. Davis
*Attorney, Agent, or Firm*—Mark E. Ogram P.C.

[57] ABSTRACT

A label holder which is formed by an exterior portion having a label holding envelope and an attached disk of metal (such as within a sealed envelope). The label holder is secured to the user's clothing through magnetic forces which are exerted by a magnet placed on the inner surface of the clothing. The metal disk is attracted to the magnet and is held to the clothing without the need of pins or other fasteners which pierce the clothing and can cause damage thereto.

12 Claims, 3 Drawing Sheets

MAGNETIC NAME-TAG

BACKGROUND OF THE INVENTION

This invention relates generally to mechanisms used to identify users and more particularly to name-tags.

To an ever growing number of people, business requires the attendance at a variety of symposiums, meetings, seminars, and shows where others at the function are seldom known. In such situations, a common practice is to provide the attendees with labels which are pinned or pasted onto the attendee's clothing. In such situations, the attendees are often wearing expensive clothing which the attendee wants to maintain in a quality condition.

The paste-type of label tends to leave a residue and is often not tailorable by the wearer to include their company logo as the label is often printed by the hosting organization. Further, should the attendee want to leave the symposium, the pasted label is not removed since its removal destroys its capability to be used again when the attendee returns to the symposium.

In the case of a pinned label holder, the mere insertion and removal of the pin causes minute damage to the cloth which becomes greatly aggregated through repeated use. In some fabrics, such as silk, the use of a pinned label is totally unacceptable as even a single use damages the delicate material.

Further, the pin on the label has a sharp end which often pricks the wearer which can cause a drop of blood to stain or damage fine clothing.

It is clear that there is a need for an efficient mechanism to secure and release name tags from a user.

SUMMARY OF THE INVENTION

The present invention includes a label holder which has an exterior portion having a label holding envelope and a sealed envelope containing a disk of metal therein. The exterior portion of the label holding envelope is transparent (such as clear plastic) which allows a printed label therein to be readily read.

In the preferred embodiment, the back surface of the label holding envelope shares a sealed envelope containing a metal member which is attracted to magnetic forces. The preferred metal member is a disk of steel being generally circular in nature. In another embodiment, the metal member covers substantially the entire back surface; in still another embodiment, the metal member is a flat strip which extends from one edge of the back surface to the other edge.

In order to secure the label holder to the user's clothing, a magnet is positioned on the inner surface of the user's blouse or shirt while the label holder's metal disk is positioned on the exterior surface of the clothing. Through magnetic force, the magnet/metal press the cloth between the two of them to secure the label holder to the shirt or blouse.

The metal disk is attracted to the magnet. In this context, the level of "squeezing" performed by the magnet and metal is determined by the amount of metal used and the magnetic strength created by the magnet.

As an alternative embodiment, the rear panel of the label holder is "doped" with metal shavings during its creation. This doping of metal provides an entire surface which responds to the magnetic forces created by the magnet.

In one embodiment of the invention, a mild adhesive is placed on one side of the magnet. This adhesive is sufficient to secure the magnet to the interior surface of the shirt or blouse so that when the label holder is removed, the magnet does not fall.

This embodiment is particularly useful where the user wants to periodically remove the label (i.e. when they leave the pavilion for lunch at a restaurant) and does not want to have to maneuver the magnet as well. The magnet is simply left in place for later use when the user returns to the pavilion.

In this manner, the label holder is securely held to the clothing without the need of pins or other fasteners which pierce the clothing and can cause damage thereto.

The invention, together with various embodiments thereof will be more fully explained by the accompanying drawings and the following explanation.

DRAWINGS IN BRIEF

DRAWINGS IN DETAIL

Figure 1:
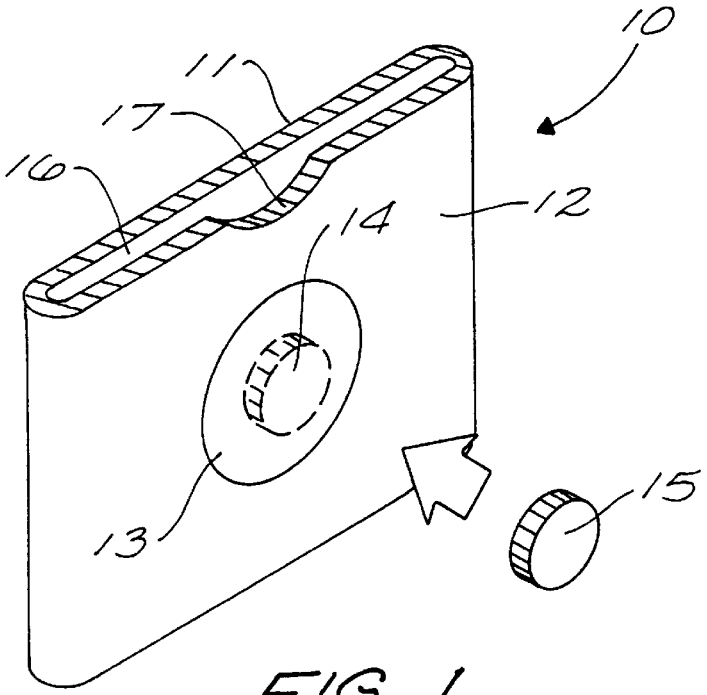
FIG. 1 is a perspective view of the preferred embodiment of the invention.

FIG. 1 is a perspective view of the preferred embodiment of the invention.

Label holder 10 has a front panel 11 which is clear so that a label is readily read therethrough. Rear panel 12 is secured to front panel 11 such that, in this embodiment, opening 16 is created allowing a printed label (not shown) to be inserted therein.

Rear panel 12 also has secured thereto a sealed envelope 13 which contains metal disk 14. Sealed envelope 13, in this embodiment, is positioned substantially at the center of rear panel 12. Finger index 17 is positioned at a top edge of rear panel 12 directly over sealed envelope 13.

Finger index 17 permits the user to obtain tactile positioning information as label holder is being positioned onto the garment relative to magnet 15.

Figure 2:
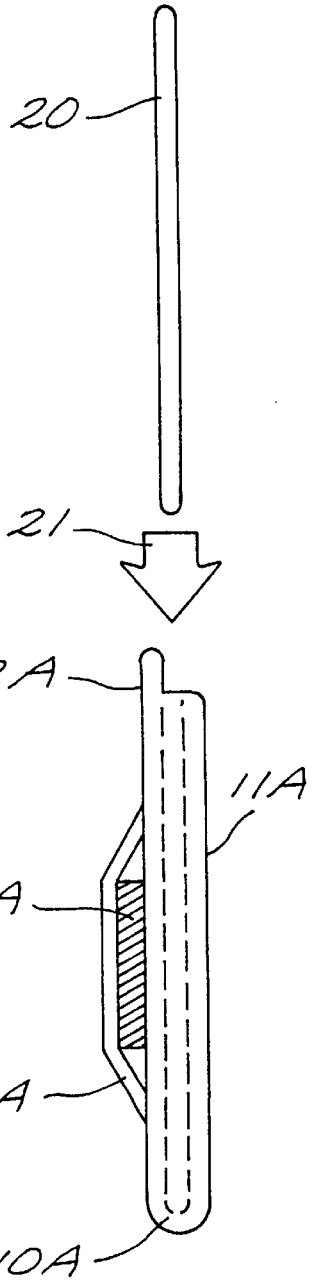
FIG. 2 is a side view of an embodiment of the invention showing the label holder and its receipt of the printed label.

FIG. 2 is a side view of an embodiment of the invention showing the label holder and its receipt of the printed label.

In this embodiment, rear panel 12A extends above front panel 11A of label holder 10A. Using the opening at the top, label 20 is readily inserted between the two panels as indicated by arrow 21.

As discussed before, sealed envelope 13A encloses metal disk 14A to rear panel 12A.

In some embodiments, rear panel 12A is clear while in other embodiments, rear panel 12A is colored or contains a printed message therein. One such message includes the trademark of the manufacturer of the label holder. This trademark is not visible when label 20 is positioned, but, when label 20 has been removed, the trademark is clearly read through front panel 11A; thereby permitting the user to identify the manufacturer for the next order of label holders.

Figure 3:
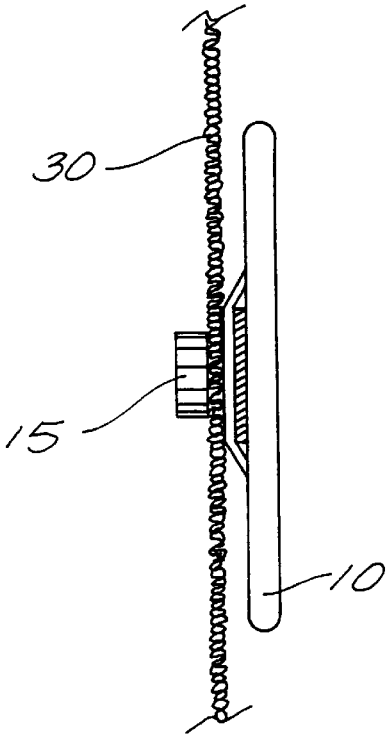
FIG. 3 is a side view of the preferred embodiment secured to a garment.

FIG. 3 is a side view of the preferred embodiment secured to a garment.

Magnet 15 draws label holder 10 firmly against garment 30. The strength of the attraction is determined by the mass of metal disk and the strength of magnet 15. In some situations, a moderately strong magnet is sufficient (i.e. for a polyester blouse) while in other applications, a stronger magnet is required (i.e. for a cotton work shirt) to obtain proper adhesion of the label holder 10 to garment 30.

Figure 4A:
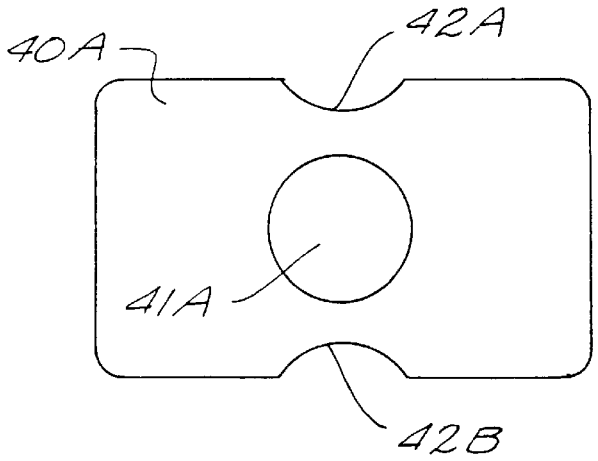
FIGS. 4A and 4B are views of alternative embodiments illustrating two placements for the finger indexes.
Figure 4B:
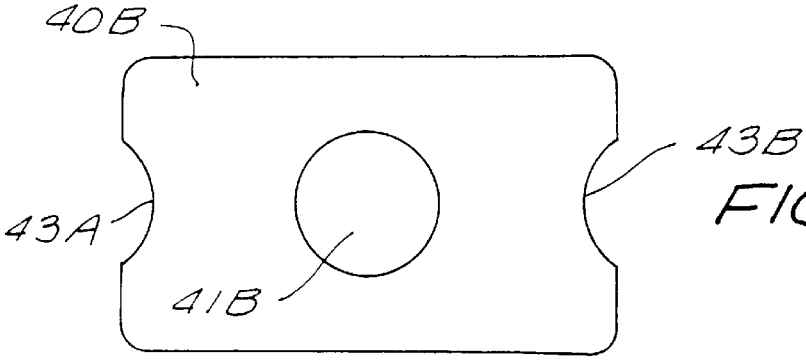

FIGS. 4A and 4B are views of alternative embodiments illustrating two placements for the finger indexes.

In the embodiment of FIG. 4A, rear panel 40A has metal disk 41A secured thereto. Metal disk 41A is positioned substantially at the center of rear panel 40A. At the top edge and at the bottom edge of rear panel 40A are positioned finger indexes 42A and 42B respectively. When the user grasps rear panel 40A by finger indexes 42A and 42B, the user's fingers are positioned in line with metal disk 41A. This tactile feed-back permits the user to accurately identify the location of metal disk 41A so that it can be positioned relative to the magnet (not shown).

In similar fashion, FIG. 4B illustrates the situation where finger indexes 43A and 43B are positioned at the side edges of rear panel 40B. Again, finger indexes 43A and 43B are in line with metal disk 41B permitting the user to "target" metal disk 41B.

Figure 5:
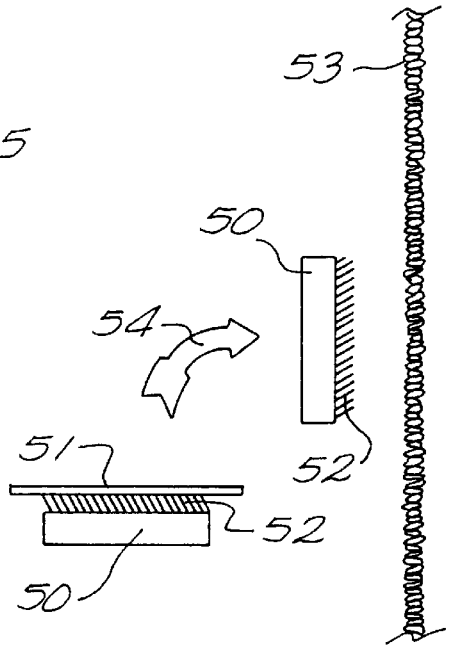
FIG. 5 illustrates the placement of an embodiment of the magnet which has one side treated with a mild adhesive.

FIG. 5 illustrates the placement of an embodiment of the magnet which has one side treated with a mild adhesive.

In some applications, the user of the label holder wishes to periodically remove the label holder. In such situations, magnet 50 is preferably used. Magnet 50 comes packaged with mild adhesive 52 on one side thereof. A releasable paper backing 51 is provided to protect mild adhesive 52 until such time that magnet 50 is intended to be used.

In using magnet 50, paper backing 51 is peeled away to expose mild adhesive 52. Magnet 50 is then pressed against an interior surface of garment 53 as illustrated by arrow 54. Mild adhesive 52 secures magnet 50 to garment 53; thereby permitting the label holder (not shown) to be removed whenever the user desires without the need to "catch" magnet 50.

Figure 6:
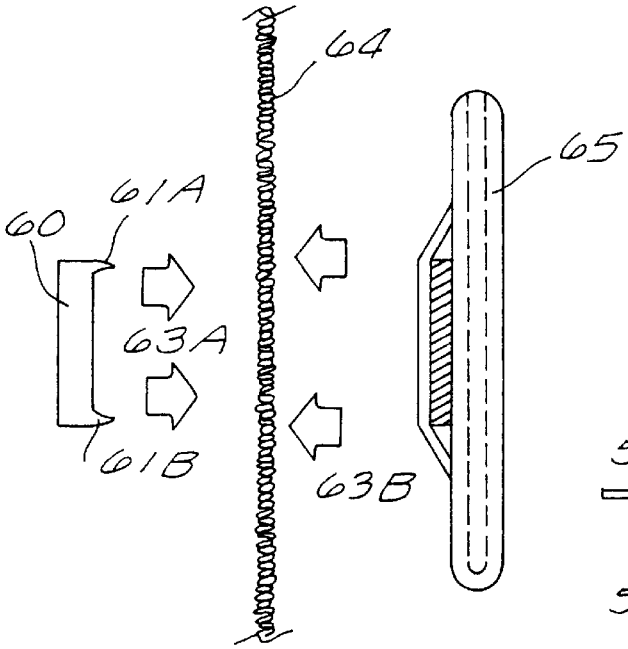
FIG. 6 is a side view of the placement of an embodiment of the magnet having prongs to provide additional adherence to the garment.

FIG. 6 is a side view of the placement of an embodiment of the magnet having prongs to provide additional adherence to the garment.

In this embodiment, magnet 60 is provided with two prongs 61A and 61B. While this embodiment uses two prongs, any number of prongs is available.

Prongs 61A and 61B are intended to partially penetrate garment 64 when magnet 60 is pressed, as indicated by arrows 63A, against garment 64. Label holder 65, with its attendant metal disk, is placed as indicated by arrows 63B to also draw prongs 61A and 61B into garment 64.

Prongs 61A and 61B, once pressed into garment 64, prevent the assembly from "slipping" from the desired position and are particularly advantageous with slick garments made of silk or nylon.

Figure 7:
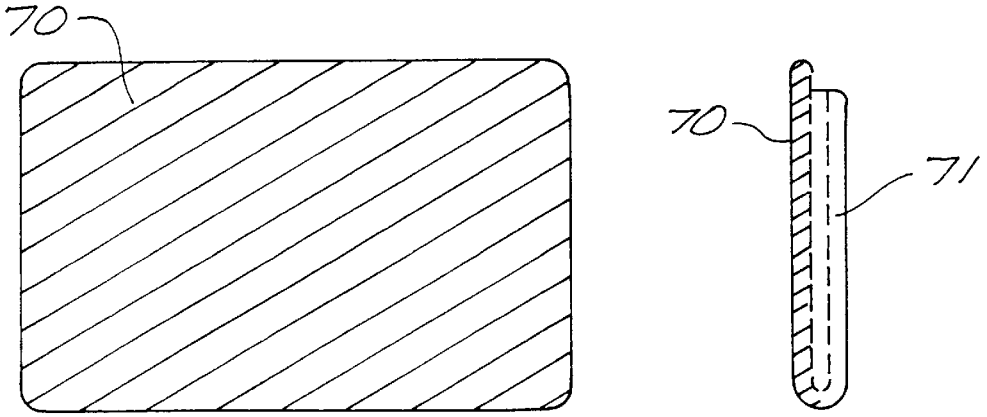
FIG. 7 is a back and side view of an embodiment of the invention in which the rear panel has been doped with metal shavings.

FIG. 7 is a back and side view of an embodiment of the invention in which the rear panel has been doped with metal shavings.

Rear panel 70 has a generally uniform doping of metal particles placed within the plastic material itself. These metal particles may be flakes of metal but are preferably metal dust. The metal doping tends to obscure visibility through the plastic composing rear panel 70, so front panel 71 is preferably not doped with any metal.

This embodiment allows the user to position the magnet anywhere relative to the rear panel and still obtain adhesion thereto. In this embodiment, finger indexes are generally not used.

Figure 8:
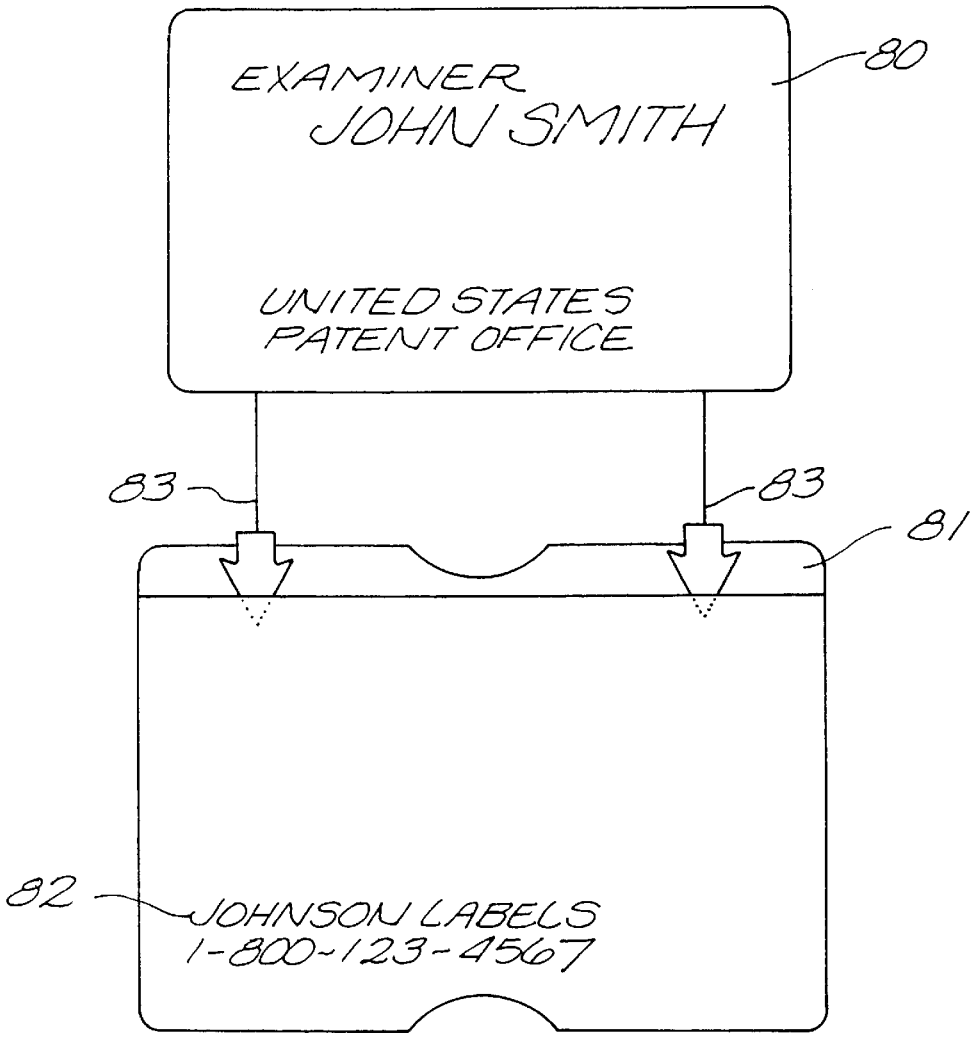
FIG. 8, is a frontal view of an embodiment of the invention in which imprinting on the rear panel is visible through the front panel.

FIG. 8, is a frontal view of an embodiment of the invention in which imprinting on the rear panel is visible through the front panel.

Label 80 identifies the attendee and is inserted into label holder 81 as illustrated by arrows 83. When label 80 is contained with label holder 81, printing 82, on the back panel of label holder 81, is obscured; but, without label 80, printing 82 is clearly visible through the front panel of the label holder.

As noted earlier, printing 82 is created during manufacture of the label holder. The preferred content for printing 82 is an identifier of the label holder's manufacturer. This allows a user to easily make another order for the product.

It is clear that the present invention creates a highly versatile name tag that permits easy attachment of release without damaging the user's clothing.

What is claimed is:

1. A name-tag combination comprising:

a) a holder having, 1) a primary envelope configured to accept a label, said primary envelope having a front panel and a rear panel, said rear panel having a first finger index located at a center location and along an upper edge of said rear panel, said rear panel further having a second finger index located at a center location and along a lower edge of said rear panel, 2) a sealed envelope formed substantially at a center location of the rear panel of said primary envelope, and, 3) a metal member being totally contained within said sealed envelope; and, b) a magnet adapted to be placed to form magnetic attraction with said metal member.

2. The name-tag according to claim 1, wherein said magnet is substantially smaller than said metal member.

3. The name-tag combination according to claim 2, wherein said magnet includes at least two prongs adapted to engage an interior surface of an article of clothing.

4. The name-tag combination according to claim 1, wherein a surface of said magnet is coated with an adhesive.

5. The name-tag combination according to claim 4, further including a releasable covering secured to the adhesive on said magnet.

6. The name-tag combination according to claim 1, wherein said sealed envelope is positioned substantially at a center location of said rear panel of said primary envelope.

7. A combination comprising:

a) an article of clothing adapted to be worn; and, b) a name-tag holder having, 1) a label, 2) a holder having, A) a primary envelope configured to accept said label, said primary envelope having a front panel and a rear panel, said rear panel having a first finger index located at a center location along an upper edge of said rear panel, said rear panel further having a second finger index located at a center location along a lower edge of said rear panel, and, B) a sealed envelope formed in the rear panel of said primary envelope containing a planar metal member, said sealed envelope positioned substantially at the center of said rear panel; and, c) a magnet adapted to be placed on an interior surface of said article of clothing to form magnetic attraction with said metal member positioned on an exterior surface of said article of clothing.

8. The combination according to claim 7, wherein said magnet is substantially smaller than said metal member and includes at least two prongs adapted to engage said interior surface of said article of clothing.

9. The combination according to claim 7, wherein said sealed envelope is positioned substantially at a center location of said rear panel of said primary envelope.

10. A label holder comprising:

a) a primary envelope configured to accept a label, said primary envelope having a front transparent panel and a rear panel, said rear panel having a first finger index located at a center location along an upper edge thereof, said rear panel further having a second finger index located at a center location along a lower edge thereof;

b) a metal member secured to said rear panel substantially at a center location thereof; and, c) a magnet adapted to be placed on an interior surface of an article of clothing such that magnetic force secures said primary envelope to an exterior surface of the article of clothing.

11. The label holder according to claim 11, wherein said magnet includes at least two prongs adapted to engage said interior surface of said article of clothing.

12. The label holder according to claim 11, wherein said metal member is positioned substantially at a center location of said rear panel of said primary envelope.

* * * * *